US005312043A

United States Patent [19]

Whitney

[11] Patent Number: 5,312,043

[45] Date of Patent: May 17, 1994

[54] PARKING LOT PAINT STRIPING CART

[76] Inventor: James R. Whitney, P.O. Box 4000, Woodbridge, Va. 22194

[21] Appl. No.: 73,673

[22] Filed: Jun. 8, 1993

[51] Int. Cl.[5] ..... B05B 13/02

[52] U.S. Cl. ..... 239/754; 239/176

[58] Field of Search ..... 239/146, 150, 151, 159, 239/164, 166, 169, 172, 175, 176, 754

[56] References Cited

U.S. PATENT DOCUMENTS

| | | | |
|---|---|---|---|
| 1,043,929 | 11/1912 | Heard | 239/167 |
| 1,326,726 | 12/1919 | Halsey . | |
| 1,629,160 | 5/1927 | Heermance | 239/150 |
| 2,831,728 | 4/1958 | Notz | 239/151 |
| 3,162,369 | 12/1964 | Mitchell | 239/150 |
| 3,199,423 | 8/1965 | Dickey | 239/159 |
| 3,202,359 | 8/1965 | Gill | 239/150 |
| 3,352,283 | 11/1967 | Maus . | |
| 3,619,311 | 11/1971 | Rose | 118/323 |
| 4,256,168 | 3/1981 | Hein et al. . | |
| 4,946,102 | 8/1990 | DeWitt et al. . | |

FOREIGN PATENT DOCUMENTS

| | | | |
|---|---|---|---|
| 2041785 | 9/1980 | United Kingdom | 239/176 |

*Primary Examiner*—Karen B. Merritt
*Attorney, Agent, or Firm*—Thomas J. Greer, Jr.

[57] ABSTRACT

A paint striping cart is provided with a parallelogram linkage oscillatable in a horizontal plane. The forward arm of the linkage carries a downwardly directed nozzle which sprays paint in a fan or web, i.e., in a plane. The parallelogram linkage is actuated by a handle and linkage assembly on the cart, the action being such that the nozzle may be swung to any lateral position, within a range of about 60 degrees with respect to the cart longitudinal axis (being its direction of travel) on either side of the cart. In operation, the cart is positioned between a pair of parked cars on a parking lot. So long as neither of the two cars overlies a worn or faded paint line between the cars, the nozzle can be positioned over the worn line and fresh paint discharged from the nozzle to renew the line as the cart is pushed or pulled along a straight path. The parallelogram linkage insures that the angle which the plane of the sprayed paint fan makes with the direction of motion of the cart is independent of the amount or extent of swing of the parallelogram.

4 Claims, 3 Drawing Sheets

PARKING LOT PAINT STRIPING CART

BACKGROUND OF THE INVENTION

This invention relates to a striping mechanism and more particularly to a cart adapted to spray paint lines on parking lots between parked cars.

The spraying art is aware of constructions for mounting paint spray nozzles or heads to an apparatus for spraying paint to form marking lines on tennis courts, ball fields, parking lots, and the like. Such a device is shown in U.S. Pat. No. 1,326,726 issued to Halsey. The art is also aware of adjustable linkage supports for paint spray nozzles. Such a construction is shown in U.S. Pat. No. 1,043,329 issued to Heard.

While these and other known devices are apparently satisfactory for their respective purposes, they are not suitable for renewing faded or worn lines for many parking lots, such as those in the vicinity of airports, where cars are parked at all times. The current practice of spraying paint lines utilizes a paint spray nozzle having a fan pattern discharge. If the nozzle rotates during spraying, the plane of the fan or web of paint will also rotate. This will cause the paint stripe to vary in width. Hence there exists a need for a line marking mechanism or cart capable of painting fresh lines over existing lines between parked cars, taking into account the fact that parked cars are not uniformly spaced from the painted lines which define the parking slots, and that the paint nozzle will be rotated varying amounts, to overlay the existing stripe.

SUMMARY OF THE INVENTION

According to the practice of this invention, a cart is provided with a parallelogram linkage swingable or oscillatable in a horizontal plane. The forward end of the linkage carries a vertically disposed plate upon which is mounted a downwardly directed paint spray nozzle, of the fan or web jet type, for spraying fresh lines on a parking lot or other horizontal, flat surface. In operation, when worn lines are to be repainted, the cart is pushed between two parked cars. Depending upon how far each of the neighboring pair of cars is spaced from the line between them, the operator adjusts the parallelogram linkage visually so that the paint spray nozzle directly overlies the worn or faded line. The operator then actuates the nozzle to spray fresh paint on the faded line, while pulling or pushing the cart along a straight path. This process is repeated for all of the faded lines between next adjacent pairs of parked cars. The cart may carry its own paint supply or the paint supply may be supplied to the nozzle by means of a flexible hose coupled to a nearby paint supply.

As noted above, line marking nozzles currently employed spray the paint in the form of a diverging fan or web, the fan defining and lying in a plane. If the nozzle were to rotate with the swinging of an arm or support upon which it is mounted, the width of the line formed by the sprayed paint would vary, depending on the amount of arm rotation. By mounting the nozzle on the vertical plate, with the plate forming one leg of the parallelogram linkage, the plane of the plate and hence the plane of the fan of sprayed paint remains fixed in orientation regardless of the angle of rotation or amount of swing of the parallelogram arms connected to the vertical plate: Preferably, the plane of the fan of sprayed paint is orthogonal to the direction of motion of the cart. By this arrangement of elements, a line of full width is sprayed onto the pavement or other horizontal surface to be marked no matter how much the parallelogram arms are rotated.

DETAILED DESCRIPTION OF THE INVENTION

Figure 1:
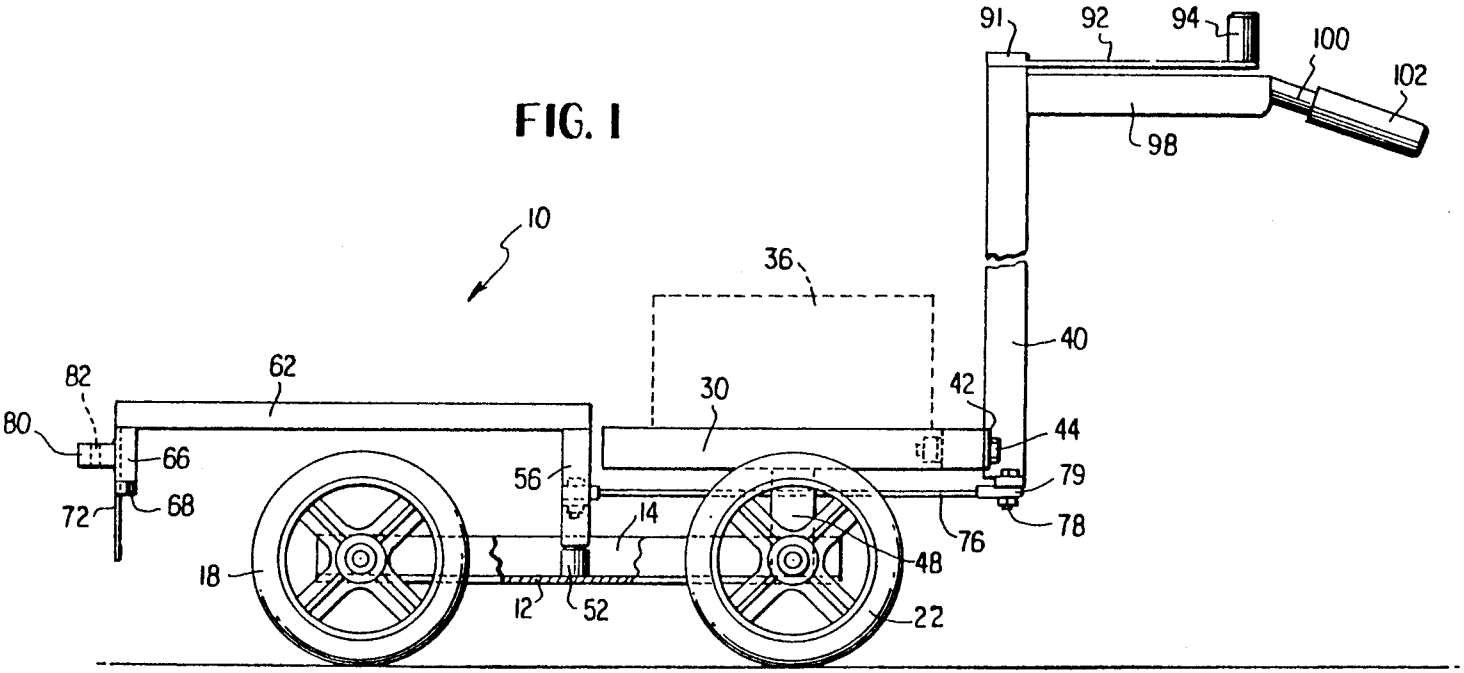
FIG. 1 is a side elevational view of the striping cart of this invention.

Referring now to the drawings, the paint striping cart of this invention is denoted generally as 10, the cart having a flat rectangular base 12 and upstanding side walls 14. Except for the two handles, later to be described, all the elements are fashioned from metal. Each of a front pair of wheels 18 is secured to a front axle 20, the latter passing through aligned openings in upstanding walls 14. Similarly, each of a pair of rear wheels 22 is secured to an axle 26, the latter also passing through opposed and aligned openings in upstanding walls 14. A generally U-shaped yoke defined by parallel hollow pipe members 30 are adapted to form a support for an optional paint supply container 36, the later indicated at dashed lines at FIG. 1. Typically, the U-shaped yoke defined by square pipes 30 and 32 is formed by welding the ends of square, hollow pipe member 32 to pipe members 30. An upstanding square hollow pipe 40 is provided near its lower end with flanges 42, the latter receiving fasteners 44 for securing pipe 40 to the U-shaped yoke 30, 32.

Figure 4:
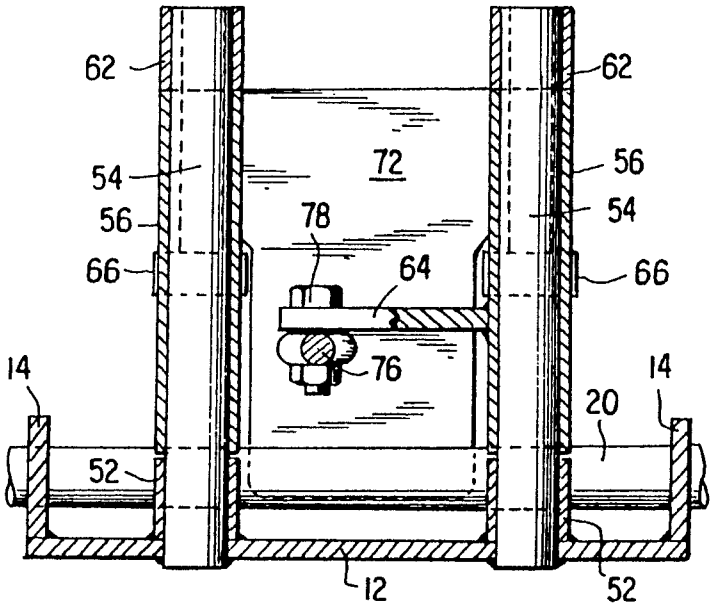
FIG. 4 is a view taken along section 4—4 of FIG. 2.

As indicated at FIG. 4, base 12 is provided with a pair of collars or short cylinders 52, typically welded thereto, with each collar receiving a respective vertically extending rod 54. The lower ends of rods 54 are welded to base plate 12. Cylinders 56 receive rods 54, with cylinders 52 and 56 being aligned.

As shown at FIGS. 1 and 4, the upper ends of cylinders 56 are welded to horizontal pipes 62 at the rear ends of pipes 62. The forward ends of pipes 62 are each pivotally secured to a downwardly extending pipe 66, each of the latter receiving a bolt 68 extending therethrough. The sides of a vertically extending mounting plate 72 are fixedly secured between and to the exterior of respective pipes 66, as by welding.

Figure 3:
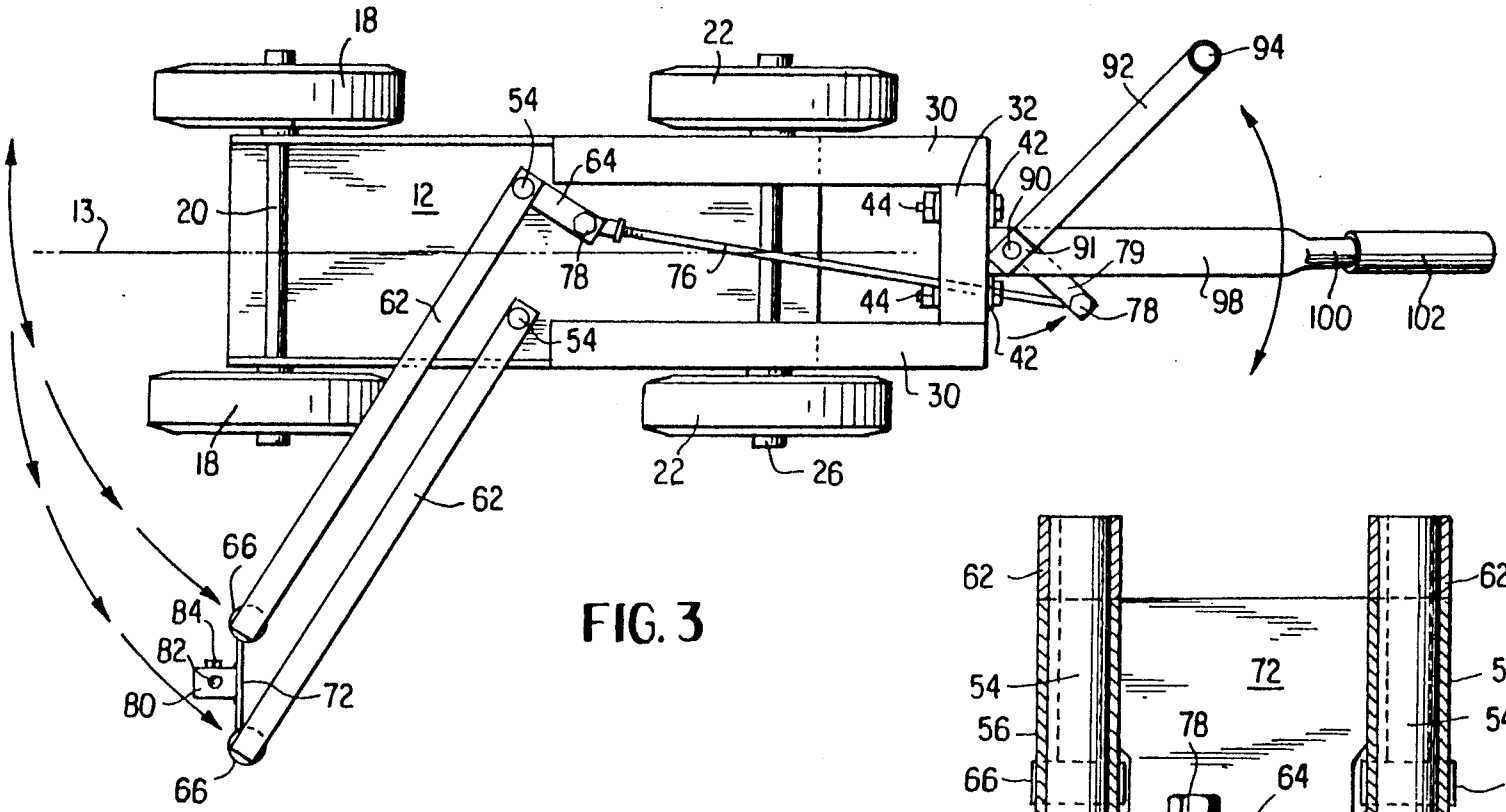
FIG. 3 is a view similar to FIG. 2 illustrating the swinging action of a parallel linkage carried by the striping cart.

It is seen that the two upstanding rods 54, pipes 62, pipes 66 (with their respective bolts 68 passing therethrough), and plate 72 form a parallelogram linkage, the linkage pivotable about rods 54, as indicated by the curved arrows at FIG. 3. The forward arm of the parallelogram linkage is defined by plate 72 and pipes 66. The other arms of the parallelogram linkage are defined by pipes 62 and their rearward fixed pivot rods 54. The ends of the forward arm are secured to the forward ends of arms 62 by the pivotal joints between pipes 66 and the forward ends of arms 62.

As shown at FIGS. 1–3 and 5, plate 72 is provided with a block 80 welded to plate 72, the block having a vertical hole 82 therethrough and a tightening bolt 84 for locking a rod in place in hole 82.

Figure 2:
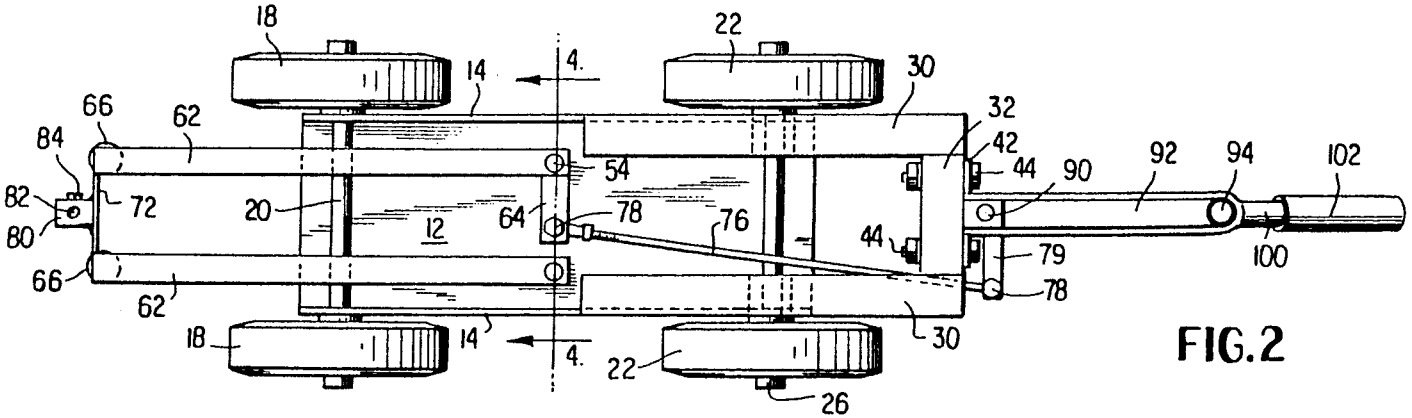
FIG. 2 is a top plan view of the striping cart.

As illustrated at FIGS. 2, 3, and 4, one of the vertically extending sleeves 56 carries a first stub arm 64 as by welding, with the free end of arm 64 pivotally secured to rod 76 by means of a fastener 78. The other end of rod 76 is secured by another fastener 78 to a second stub arm 79. In turn, second stub arm 79 is fastened as by welding to the lower end of vertical standard 90, the latter positioned interiorly of pipe element 40 and oscillatable therein. The upper end of standard 90 is rigidly fastened to the enlarged end 91 of handle 92, with the remote end of handle 92 carrying an upstanding knob 94.

Reference to FIGS. 2 and 3 shows that rotation of handle 92, as indicated by the curved arrows of FIG. 3, results in rotation of standard 90. Rotation of standard 90 in turn is accompanied by swinging of second stub arm 79 which pulls or pushes rod 76 from the position shown at FIG. 2. Pushing knob 94 towards the right results in a counterclockwise rotation of first stub arm 64 about the upper rod 54. This, indicated by the curved arrows at the left of FIG. 3, causes movement of the parallelogram linkage, with plate 72 swinging downwardly as viewed at FIG. 3. It is seen that plate 72 is always oriented in a vertical plane.

The reader will readily visualize that rotation of arm 92 in the opposite direction causes movement of plate 72 in the opposite lateral direction. Thus, depending upon the direction of swinging of handle 92, plate 72 carrying a fan type spray nozzle 88 (of any desired construction) places the nozzle either laterally to the left or laterally to the right or centrally of the cart.

Figure 5:
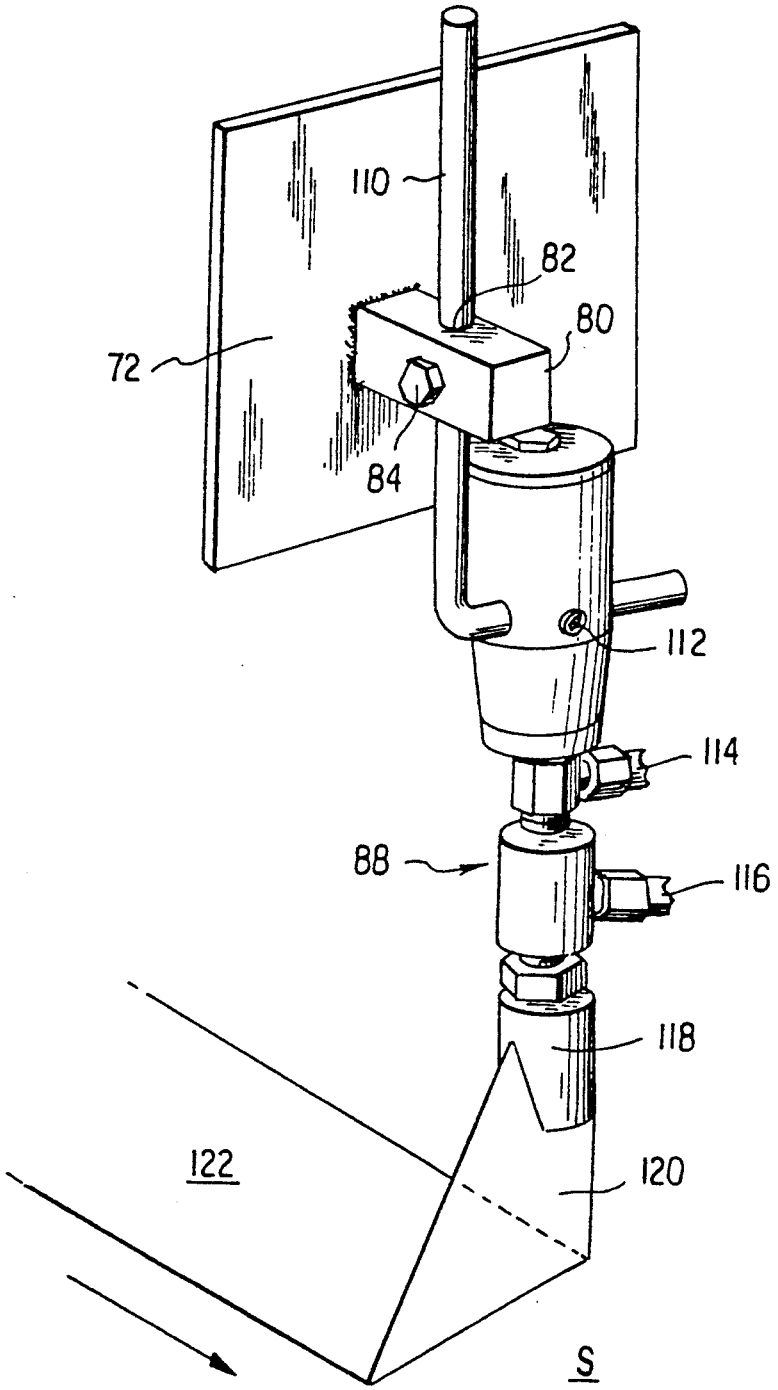
FIG. 5 is a partial perspective view illustrating the mounting of a typical paint spray nozzle on the forward portion of the striping cart of this invention.

FIG. 5 illustrates how a typical, known pressurized paint spray nozzle assembly 88 is mounted on vertical plate 72. Rod 110 passes through hole 82 of block 80 and is clamped by threaded bolt 84. The lower end of rod 110 is horizontal and passes through a portion of nozzle assembly 88, the latter coupled to air and paint lines 114 and 116. Nozzle head 118 ejects a generally diverging web or fan jet of paint 120 for depositing a paint stripe 122 on horizontal surface S, such as the surface of an airport parking lot. It will be understood that the specific pressurized paint spray nozzle assembly 88 forms no part of the invention. One such assembly is marketed by Morton International, Inc. of Salem, Oreg.

The cart is manually pushed by means of handle structure 98 and 100, with a conventional rubber sleeve 102 placed over the end of 100.

In operation, an operator pushes or pulls the cart 10 by means of handle elements 98, 100, 102 between two parked cars in a parking lot. Depending upon the relative position of the line to be repainted between the two cars, the operator will swing handle 92 in one direction or the other so as to visually vertically align paint spray nozzle 118 with the existing line which is to be repainted.

The sprayed paint fan 120 is seen to lie in and define a plane. In the configuration of FIG. 5, this plane is, in all angular positions of parallelogram arms 62 relative to the direction of cart motion, fixed with respect to the plane of plate 72. The plane of plate 72 is independent of the angular position of arms 62, and is thus orthogonal to the direction of cart travel. While the forward arm of the parallelogram linkage is shown as a plate, for ease of mounting the nozzle assembly 88, this forward arm may be a rod or other element which performs the function of a parallelogram forward link which will permit the plane of sprayed paint fan 120 to remain fixed, shown here as at a right angle, to the direction of cart travel so as to utilize the full width of the fan for depositing fresh paint over a worn paint line. Bolt 84 can be loosened, rod 110 rotated, and screw pin 112 reset so that nozzle 88 may be adjusted to direct the paint fan or web 120 against the side of a curb.

The cart 10 is typically no more than one foot wide and no more than nine inches in height, except for standard 40.

The plane of the sprayed paint fan 120 has been described as orthogonal to the direction of cart travel. In this manner, the full width of the sprayed paint fan 120 is utilized. If desired, the nozzle head 118 may be raised or lowered by adjusting bolt 84 so as to make a wider or narrower line of stripe 122.

Pushing or pulling the cart is done where the operation is to be manually carried out. However, the cart may be provided with its own means of locomotion, such as an auxiliary engine of any desired type. Paint supply line 116 and air supply line 114 may each extend to a movable supply vehicle, not shown, such as a truck or wagon.

In the above description, handle 92 is described as rotatable to cause swinging movement of the parallelogram linkage defined by parallel arms 62, plate 72, and the rigid portion of base 12 between rods 54. If, however, the rotation of arms 62 about their ends is made stiff enough, as by introducing stiffness to the joints at the ends of arms 62, the arms will remain in whatever angular position they are placed. The arms may then be made to assume a desired angular position relative to the cart axis 13 merely by kicking plate 72 or by moving plate 72 by hand. In this case, the stub arms, rod 76, standard 90, and handle 92 may all be omitted.

I claim:

1. A paint striping cart for painting lines on a surface, such as between parked cars in a parking lot, the cart including a base on which a plurality of wheels are mounted, a parallelogram linkage having first and second parallel arms, first respective ends of said first and second parallel arms, each having a respective fixed pivot point secured to said base at spaced apart locations on said base, said parallelogram linkage having a forwardmost third arm having two ends, each said forwardmost arm end being pivotally secured to a respective second end of each of said first and second arms, said parallelogram linkage forwardmost arm carrying a paint spray nozzle adapted to discharge paint in a plane, said paint discharge plane being fixed in orientation to a line of travel of the cart to thereby form a painted line of constant width independently of an angular position of said parallel arms of said parallelogram linkage, said first and second parallel arms swingable in a horizontal plane as they rotate about their respective said fixed pivot points.

2. The cart of claim 1 including means to actuate said parallelogram linkage.

3. The cart of claim 2 wherein said means to actuate said parallelogram linkage includes a first stub arm having one end rigidly secured to a first respective end of either said first or said second arm of said parallelogram linkage which is pivoted to one of said fixed pivot points, a connecting rod pivotally secured at one of its ends to the other end of said first stub arm, the other end of said connecting rod pivotally secured to one end of a second stub arm rigidly secured to the lower end of a vertically extending, oscillatable standard, said standard mounted on and carried by said cart, an oscillatable handle having one end fixedly secured to the upper end of said standard, said handle oscillatable in a horizontal plane, whereby oscillation of said handle causes actuation of said parallelogram linkage about said two fixed pivot points.

4. A paint striping cart for painting lines on a surface, such as between parked cars in a parking lot, the cart including a base and wheels mounted thereon, a parallelogram linkage having first and second parallel arms, first respective ends of said first and second parallel arms each having a respective fixed pivot point secured to said base at spaced apart locations on said base, said parallelogram linkage having a forwardmost third arm having two ends, each said forwardmost arm end being pivotally secured to a respective second end of each of said first and second arms, said parallelogram linkage forwardmost third arm fixed in orientation independently of an angular position of said parallel arms of said parallelogram linkage, said first and second parallel arms swingable in a horizontal plane as they rotate about their respective said fixed pivot points.

* * * * *